US006151803A

United States Patent [19]

Charles

[11] Patent Number: 6,151,803

[45] Date of Patent: Nov. 28, 2000

[54] PUNCTURE RESISTANT INSOLE

[76] Inventor: Nathaniel O. Charles, 111 Hummingbird Dr., Dublin, Ga. 31021

[21] Appl. No.: 09/258,104

[22] Filed: Feb. 25, 1999

Related U.S. Application Data

[62] Division of application No. 08/840,597, Apr. 22, 1997, abandoned.

[51] Int. Cl.[7] ..... A43B 13/22; A43B 13/42; A43B 23/22; A43B 1/08

[52] U.S. Cl. ..... 36/72 R; 36/85; 36/107; 36/76 C; 36/75 R

[58] Field of Search ..... 36/43, 44, 85, 36/102, 107, 76 C, 73, 75 R, 72 R

[56] References Cited

U.S. PATENT DOCUMENTS

| | | | |
|---|---|---|---|
| 1,984,576 | 12/1934 | Gordon | 36/44 |
| 3,007,083 | 10/1961 | MacQuaid, Jr. et al. | 36/43 |
| 4,271,607 | 6/1981 | Funck | 36/72 R |
| 4,702,255 | 10/1987 | Schenkl | 36/44 |
| 4,729,179 | 3/1988 | Quist, Jr. | 36/44 |
| 4,888,888 | 12/1989 | Ashton | 36/43 |
| 4,897,939 | 2/1990 | Harrington | 36/107 |
| 5,123,180 | 6/1992 | Nannig et al. | 36/43 |
| 5,285,583 | 2/1994 | Aleven | 36/44 |
| 5,546,680 | 8/1996 | Barma et al. | 36/72 A |
| 5,722,186 | 3/1998 | Brown | 36/43 |
| 5,832,634 | 11/1998 | Wong | 36/107 |

FOREIGN PATENT DOCUMENTS

| | | | |
|---|---|---|---|
| 2625655 | 7/1989 | France | 36/44 |
| 2029194 | 3/1980 | United Kingdom | 36/107 |
| 2055549 | 3/1981 | United Kingdom | 36/107 |
| 91/12740 | 9/1991 | WIPO | 36/44 |

*Primary Examiner*—Paul T. Sewell
*Assistant Examiner*—Anthony Stashick
*Attorney, Agent, or Firm*—J. Stewart Brams

[57] ABSTRACT

An insole is capable of withstanding penetration of nails and other foreign objects. The insole is constructed of a substantially flexible, substantially puncture resistant material, such as a polymer fiber. The perimeter of the insole is curved upward, and includes a plurality of substantially v-shaped notches therein to enhance flexibility of the insole. A downwardly curved portion is embedded in a sole of an article of footwear. The downwardly curved portion substantially mirrors the portion of the perimeter of the insole which is curved upward.

3 Claims, 7 Drawing Sheets

PUNCTURE RESISTANT INSOLE

CROSS-REFERENCE TO RELATED APPLICATIONS

This application is a divisional of application Ser. No. 08/840,597, filed on Apr. 22, 1997, now abandoned.

BACKGROUND OF THE INVENTION

1. Field of the Invention

The present invention relates to footwear, particularly to a nail stopping insole.

2. Description of the Related Art

Various attempts have been made in the prior art to provide a flexible insole capable of withstanding penetration of nails and other foreign objects. Heretofore, no insole has been provided which combines the flexibility, hardness, protection and simplicity of construction of the present invention.

SUMMARY OF THE INVENTION

The nail stopping insole of the present invention includes at least one portion which may be a rigid steel plate, and at least one portion of the insole which may be a substantially flexible, substantially puncture resistant material such as polymer fiber or spring steel. The portions may be hingedly connected to one another. In another embodiment, the entire insole is constructed of a substantially puncture resistant, substantially flexible material. The insole may further have an upwardly curved portion, and a downwardly curved portion embedded in a sole of an article of footwear.

DETAILED DESCRIPTION

Figure 1:
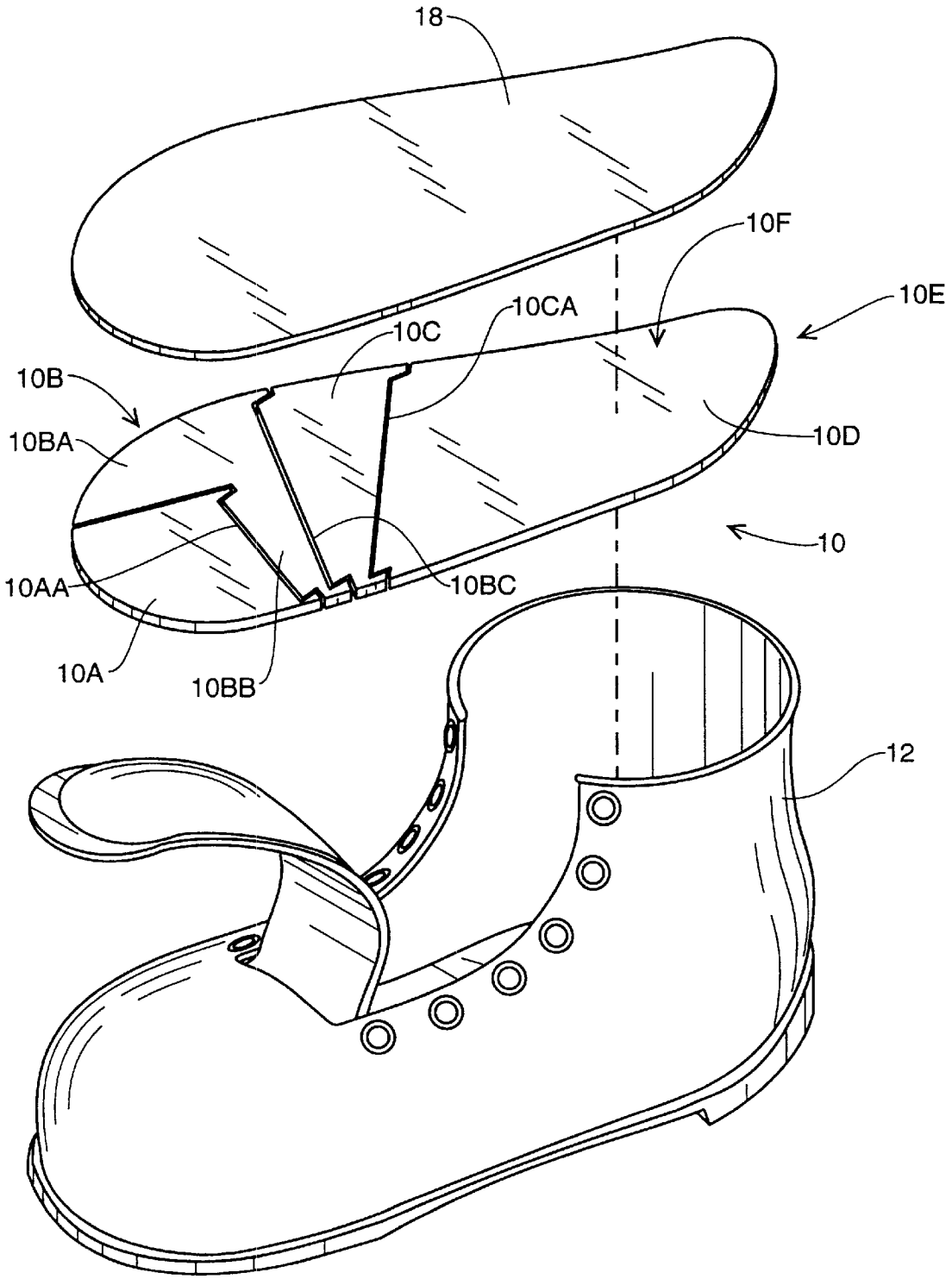
FIG. 1 is an exploded perspective view of an insole of the present invention.
Figure 2:
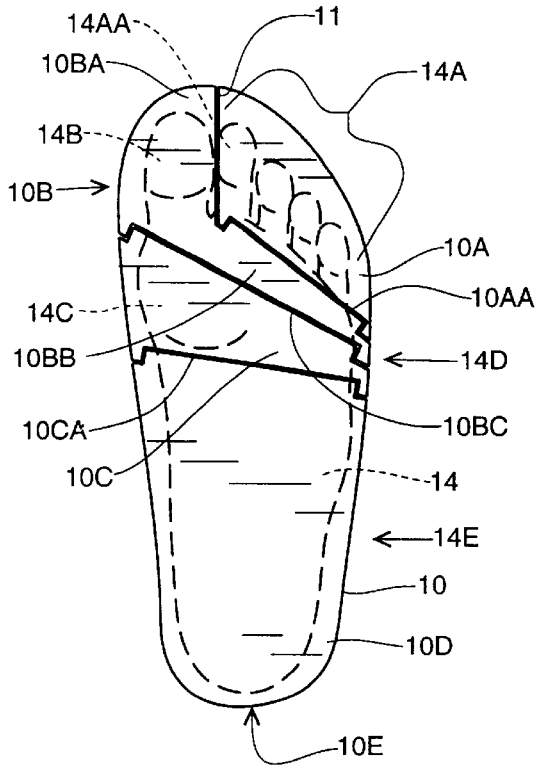
FIG. 2 is a bottom plan elevational view of the insole.

FIG. 1 is an exploded perspective view of an insole 10 capable of withstanding penetration of nails (not shown) and other foreign objects. The insole 10 may be insertable into an article of footwear 12 such as a shoe or boot, or may be a part of the footwear 12. FIG. 2 is a bottom plan elevational view of the insole 10, showing its relationship to a foot 14 placed thereon. Referring to FIGS. 1 and 2, the insole 10 includes a first portion 10A adapted for first through fourth toes 14A of a human foot 14 to rest thereon. The first portion 10A includes a first hinged connection 10AA to a second section 10BB of a second portion 10B. The first hinged connection 10AA is adapted to permit flexure of the first through fourth toes 14A.

The second portion 10B includes a first section 10BA adapted for a big toe 14B of the foot 14 to rest thereon. The second section 10BB is adapted for a portion of the foot 14 adjacent the first through fourth toes 14A to rest thereon. The first portion 10A and the second section 10BB of the second portion 10B form a gap 11 there-between. The gap 11 is adapted to be positioned between the big toe 14B and a first toe 14AA.

The second portion 10B includes a second hinged connection 10BC to a third portion 10C. The second hinged connection 10BC is adapted to permit flexure of the big toe 14B. The third portion 10C is adapted for a ball of the foot 14C adjacent the big toe 14B to rest thereon. The third portion 10C extends across the width of the insole 10.

The third portion 10C includes a third hinged connection 10CA to a fourth portion 10D. The third hinged connection 10CA is adapted to permit flexure of a front portion 14D of the foot 14 relative to a rear portion 14E of the foot 14. The fourth portion 10D extends from the third portion 10C to a rear 10E of the insole 10.

In this embodiment of the present invention, the first, second, third and fourth portions 10A, 10B, 10C, 10D are made of a substantially rigid, substantially puncture resistant material, such as steel plate or other known material. If additional flexibility is desired, the portions 10A, 10B, 10C, 10D may be constructed of a substantially flexible, substantially puncture resistant material such as polymer fiber, spring steel, chain mail or other suitable material. An example of a suitable polymer fiber is KEVLAR (™).

Figure 2A:
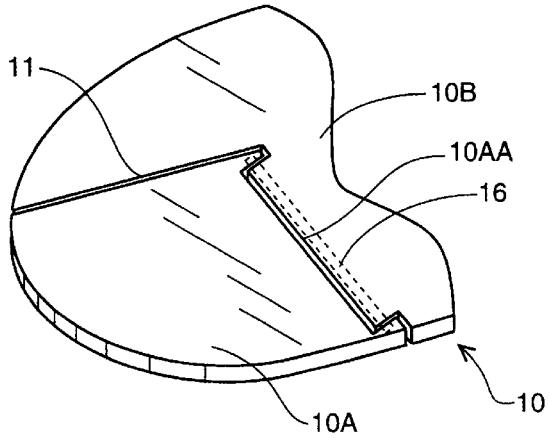
FIG. 2A is a partial enlarged perspective of the insole.

FIG. 2A is a partial enlarged perspective of the insole 10, showing the typical hinged connection 10AA, 10BC, 10CA between the portions 10A, 10B, 10C, 10D in greater detail. As shown, the portions 10A, 10B, 10C, 10D are configured to pivot about a pin 16 in a conventional manner for a hinge. Other conventional hinge structures are within the scope of the present invention.

Figure 2B:
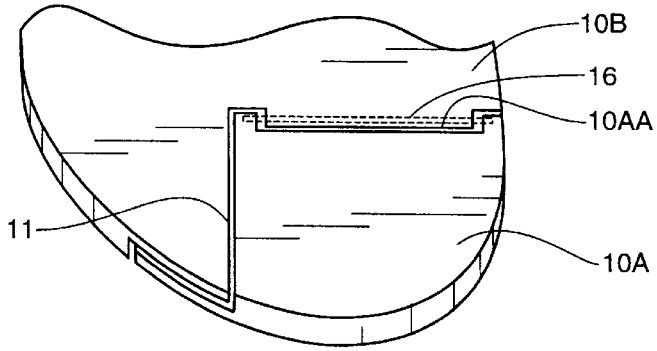
FIGS. 2B and 2C are partial enlarged perspective views of the insole, showing alternative embodiments thereof
Figure 2C:
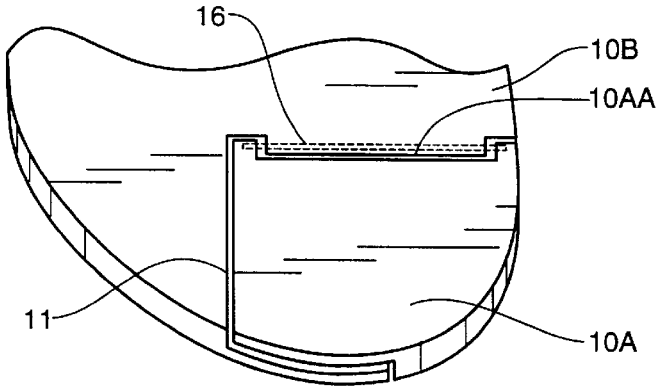

FIGS. 2B and 2C show alternative embodiments wherein the first and second portions 10A, 10B overlap each other at the gap 11 to provide further protection against nail penetration.

Referring to FIG. 1, a flexible member 18 is attached to a surface 10F of the insole 10 for foot comfort, for thermal insulation and for protecting the foot 14 from pinching between the first, second, third and fourth portions 10A, 10B, 10C, 10D. The flexible member 18 may be made of rubber or other conventional, suitable material. The flexible member 18, when made of a non-conductive material such as rubber, will help to protect the wearer of the insole 10 from electrical shock.

Figure 3:
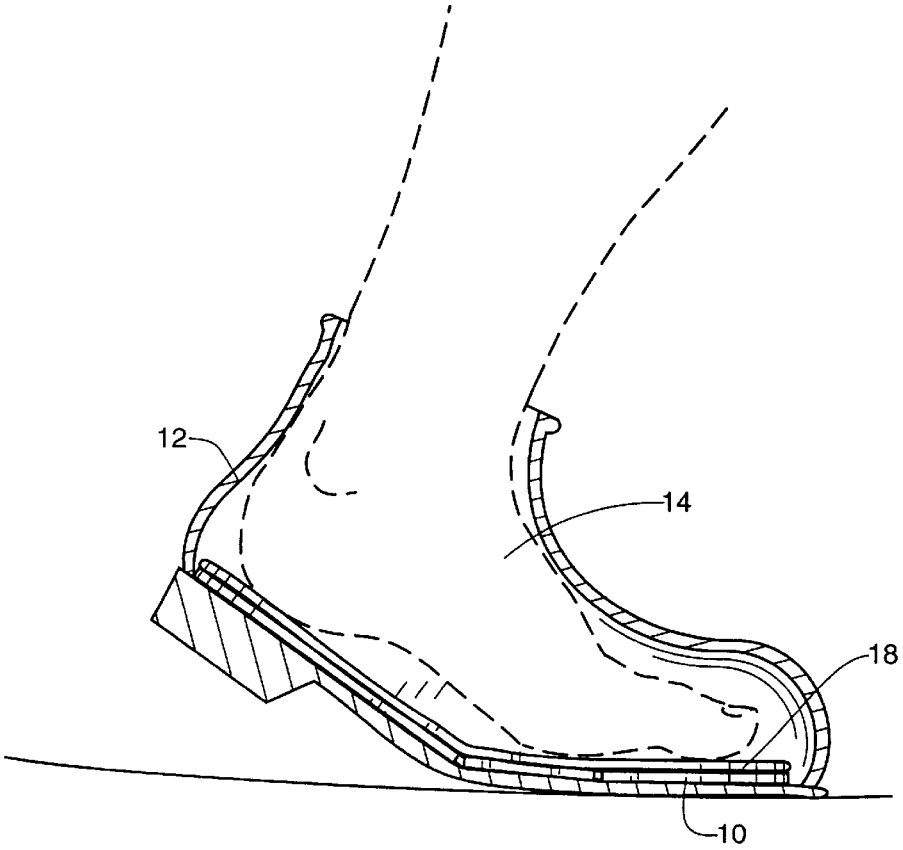
FIG. 3 is a cross-sectional view of the insole inserted in the footwear.

FIG. 3 is a cross-sectional view of the insole 10 inserted in the footwear 12, showing the insole 10 flexing at the hinged connections 10AA, 10BC, 10CA as the foot 14 bends in a normal walking motion.

Figure 4:
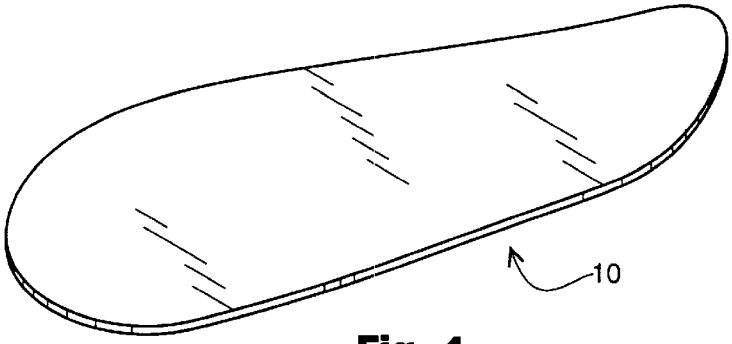
FIG. 4 is a perspective view of another embodiment of the insole.

FIG. 4 is a perspective view of another embodiment of the insole 10, which is constructed entirely of a single piece of substantially flexible, substantially puncture resistant material. As described above, the material may be a polymer fiber, such as KEVLAR (™), or may be spring steel, chain mail, or another known, suitable material.

Figure 5:
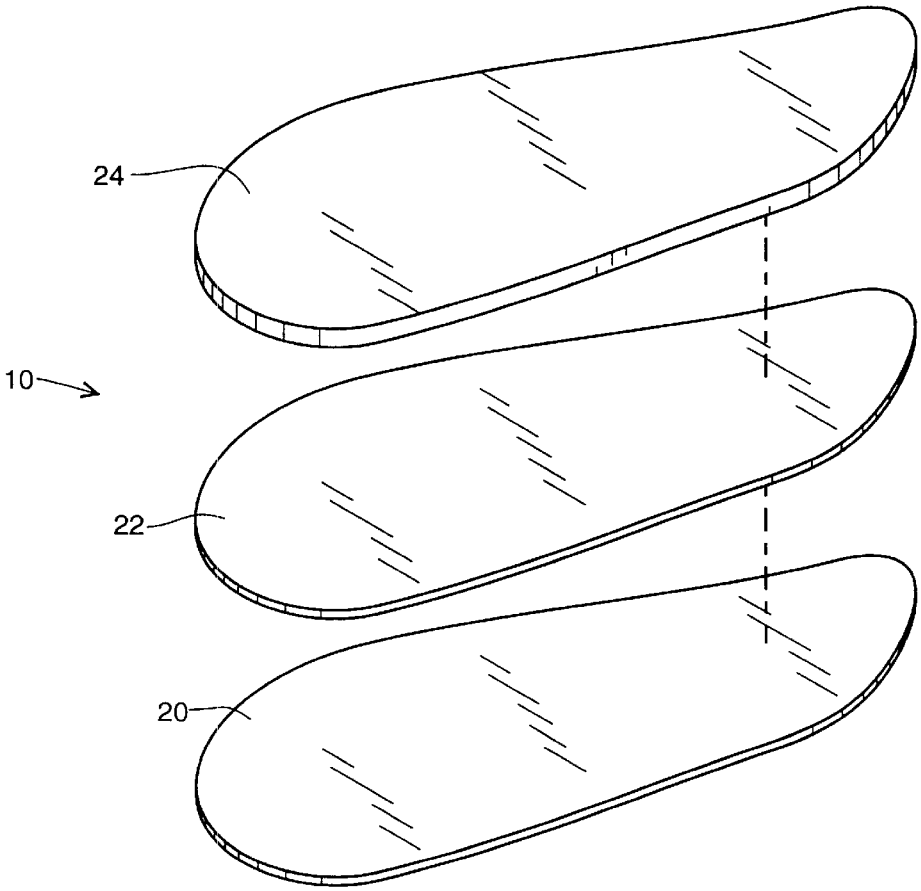
FIG. 5 is an exploded perspective view of another embodiment of the insole.
Figure 5A:
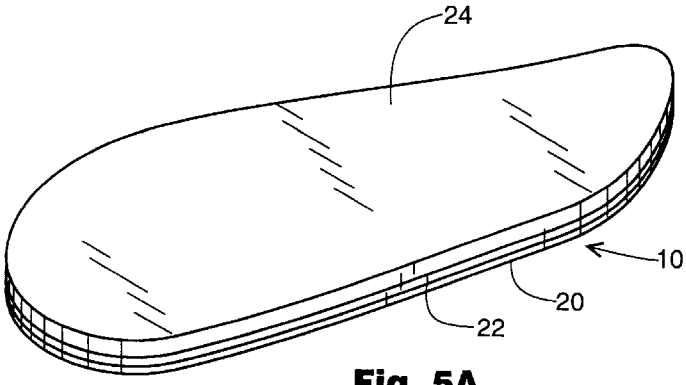
FIG. 5A is a perspective view showing the embodiment of FIG. 5 assembled.

FIG. 5 is an exploded perspective view of another embodiment of the insole 10, wherein a bottom layer 20 is constructed of chain mail of spring steel, a polymer fiber layer 22 is attached to the bottom layer 20, and a flexible layer 24 such as rubber is attached to the polymer fiber layer 22. FIG. 5A shows this embodiment assembled.

Figure 6:
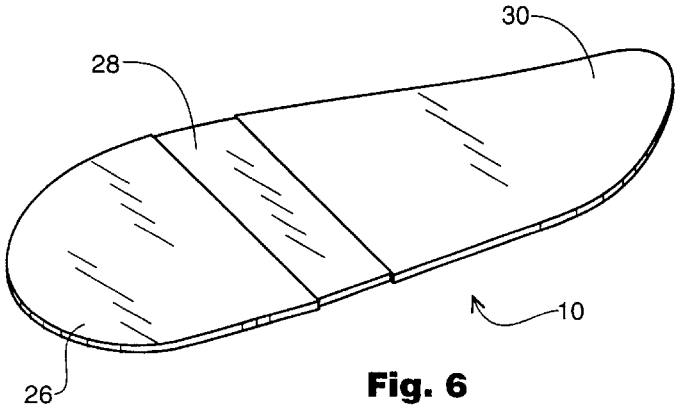
FIG. 6 is a perspective view of another embodiment of the insole.
Figure 6A:
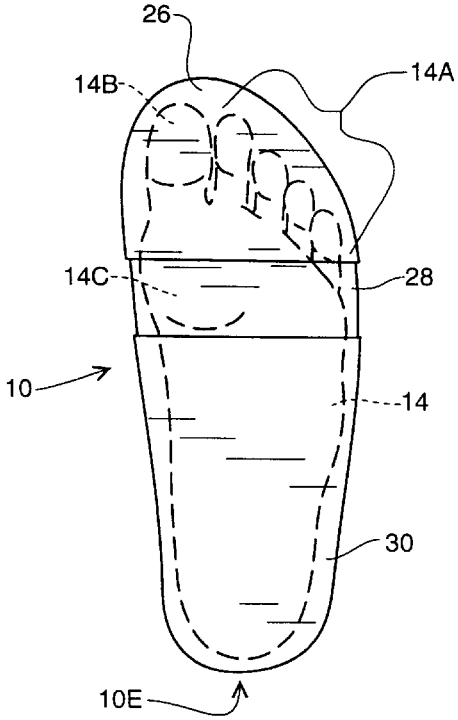
FIG. 6A is a bottom plan view of the insole, showing the foot thereon.

FIG. 6 is a perspective view of another embodiment of the insole 10, and FIG. 6A is a bottom plan view of the insole 10, showing the foot 14 thereon. A first segment 26 is adapted for the big toe 14B and the first through fourth toes 14A to rest thereon. A second segment 28 is adapted for the ball of the foot 14C adjacent the big toe 14B to rest thereon. A third segment 30 extends from the second segment 28 to a rear 10E of the insole 10. The second segment 28 is constructed of a puncture resistant, substantially flexible material such as polymer fiber or spring steel. The first segment 26 and the third segment 30 are constructed of steel plate or other rigid material. Other combinations of materials are possible. Each of the segments 26, 28, 30 are connected to each other along lines which are disposed perpendicular to a longitudinal axis of the insole 10.

Figure 7:
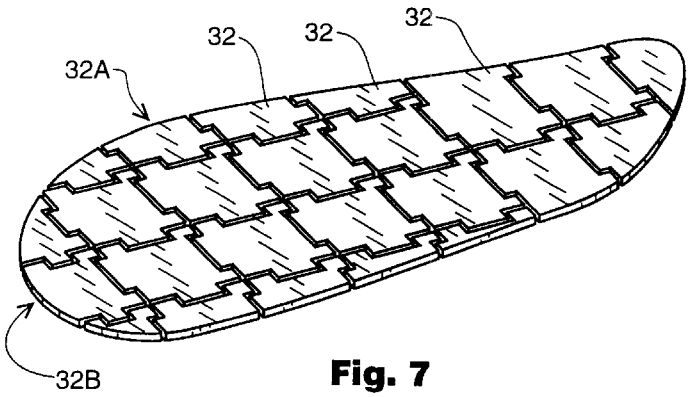
FIG. 7 is a perspective view of another embodiment of the insole.
Figure 7A:
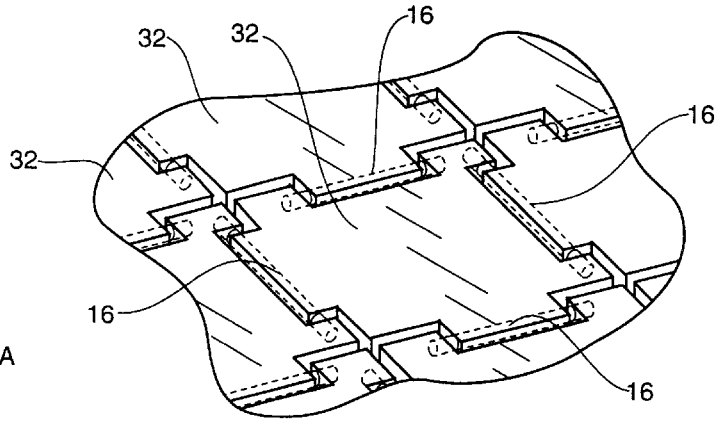
FIG. 7A is an enlarged partial perspective view of the embodiment of FIG. 7.

FIG. 7 is a perspective view of another embodiment of the insole 10, and FIG. 7A is an enlarged partial perspective view thereof. In this embodiment, a plurality of segments 32 are arranged in rows 32A and columns 32B. As shown most clearly in FIG. 7A, each of the segments 32 is hingedly connected to each of its adjacent segments 32.

Figure 8:
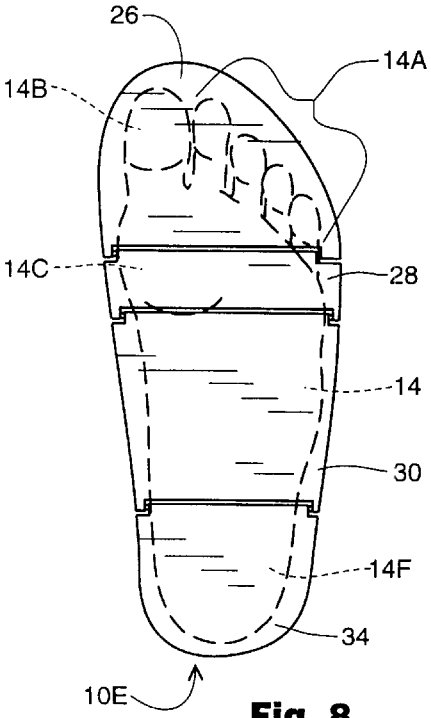
FIG. 8 is a bottom plan view of another embodiment of the insole.

FIG. 8 is a bottom plan view of another embodiment of the insole 10. The first segment 26 is adapted for the big toe 14B and the first through fourth toes 14A to rest thereon. The second segment 28 is adapted for a ball of the foot 14C adjacent the big toe 14B to rest thereon. A fourth segment 34 is adapted for a heel 14F of the foot 14 to rest thereon. The third segment 30 extends from the second segment 28 to the fourth segment 34. Each of the segments 26, 28, 30, 34 are connected to each other along lines which are disposed perpendicular to a longitudinal axis of the insole 10. Various combinations of flexible and rigid puncture resistant materials are possible with this embodiment.

Figure 9:
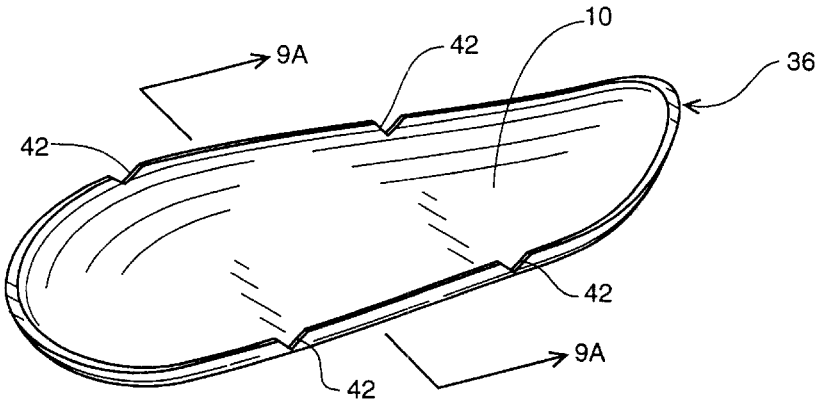
FIG. 9 is a perspective view of another embodiment of the insole.
Figure 9A:
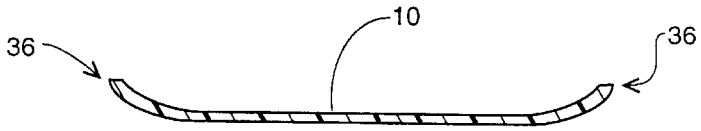
FIG. 9A is a cross-sectional view taken along line 9A—9A of FIG. 9.

FIG. 9 is a perspective view of another embodiment of the insole 10, and FIG. 9A is a cross-sectional view thereof. The insole 10 is constructed of a substantially puncture resistant, substantially flexible material, and includes a perimeter 36 which is curved upward for protection of a side of the foot 14 from nails and other foreign objects. Substantially v-shaped notches 42 enhance flexibility of the insole 10. Although the entire perimeter 36 is shown upwardly curved, the curve may be limited to only a portion of the insole 10, such as around the toes of the foot.

Figure 9B:
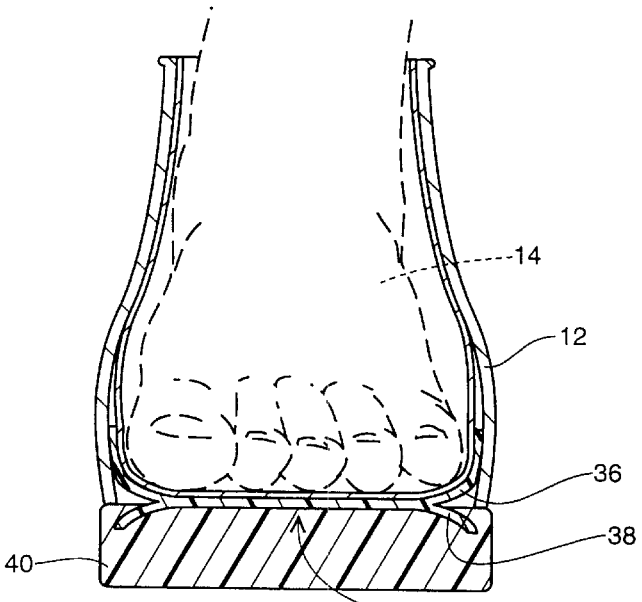
FIG. 9B is a cross-sectional view of another embodiment of the insole, embedded in the sole of an article of footwear.

FIG. 9B shows a downward extended portion 38 embedded in a sole 40 of the article of footwear 12. The downward extended portion 38 may be a downwardly curved portion mirroring the upwardly curved perimeter 36, and may include the notches 42 as described above.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. For example, various combinations of the elements of the various figures are possible. Additionally, the insole 10 of any of the embodiments may be a fixed part of a shoe, or may be removable. Accordingly, the scope of the invention is to be limited only by the following claims and their legal equivalents.

The invention claimed is:

1. An insole for an article of footwear which receives thereover the foot of a wearer and is capable of withstanding penetration of nails and other foreign objects comprising:

an expanse of thin, substantially flexible, puncture resistant material;

said expanse of material having an perimeter portion extending thereon;

said perimeter portion including an upwardly curved extending portion which extends to a laterally outer edge thereof to laterally enclose at least a lower part of a wearer's foot;

said perimeter portion further including a downwardly curved extending portion which extends to a laterally outer edge thereof and is adapted to be embedded in the sole of such an article of footwear; and said perimeter portion further including a plurality of v-shaped notches on at least one of said upwardly and said downwardly extending portions which open outwardly to the respective said laterally outer edge.

2. The insole as set forth in claim 1 wherein said upwardly extending portion and said downwardly extending portion substantially mirror each other.

3. The insole as set forth in claim 2 wherein said perimeter portion is substantially the entire perimeter of said insole.

* * * * *